US008828262B2

(12) United States Patent
Menapace et al.

(10) Patent No.: US 8,828,262 B2
(45) Date of Patent: Sep. 9, 2014

(54) METHOD AND SYSTEM FOR POLISHING MATERIALS USING A NONAQUEOUS MAGNETORHEOLOGICAL FLUID

(75) Inventors: Joseph Arthur Menapace, Livermore, CA (US); Paul Richard Ehrmann, Hughson, CA (US)

(73) Assignee: Lawrence Livemore National Security, LLC, Livermore, CA (US)

( * ) Notice: Subject to any disclaimer, the term of this patent is extended or adjusted under 35 U.S.C. 154(b) by 596 days.

(21) Appl. No.: 12/986,906

(22) Filed: Jan. 7, 2011

(65) Prior Publication Data

US 2011/0275286 A1 Nov. 10, 2011

Related U.S. Application Data

(60) Provisional application No. 61/331,948, filed on May 6, 2010.

(51) Int. Cl.
*H01F 1/44* (2006.01)
*B24B 1/00* (2006.01)

(52) U.S. Cl.
CPC ..... *B24B 1/005* (2013.01); *H01F 1/447* (2013.01); *H01F 1/442* (2013.01)
USPC ..... 252/62.51 R; 252/62.54

(58) Field of Classification Search
CPC ..... H01F 1/447; H01F 1/442
USPC ..... 252/62.51 R, 62.56; 510/175
See application file for complete search history.

(56) References Cited

U.S. PATENT DOCUMENTS

| | | | | |
|---|---|---|---|---|
| 5,804,095 | A | 9/1998 | Jacobs et al. | |
| 5,839,944 | A * | 11/1998 | Jacobs et al. | 451/8 |
| 6,027,664 | A * | 2/2000 | Weiss et al. | 252/62.52 |
| 6,106,380 | A * | 8/2000 | Jacobs et al. | 451/360 |
| 6,402,978 | B1 * | 6/2002 | Levin | 252/62.52 |
| 6,503,414 | B1 * | 1/2003 | Kordonsky et al. | 252/62.52 |
| 6,920,765 | B2 | 7/2005 | Manapace et al. | |
| 7,297,290 | B2 * | 11/2007 | Fuchs et al. | 252/62.54 |
| 2009/0014681 | A1 * | 1/2009 | Iyengar et al. | 252/62.54 |
| 2009/0211595 | A1 * | 8/2009 | Sinha | 134/1 |
| 2010/0171065 | A1 * | 7/2010 | Shen et al. | 252/62.56 |
| 2011/0062371 | A1 * | 3/2011 | Marur | 252/62.54 |
| 2011/0275286 | A1 * | 11/2011 | Menapace et al. | 451/41 |
| 2011/0318994 | A1 * | 12/2011 | Darcangelo et al. | 451/41 |
| 2012/0025128 | A1 * | 2/2012 | Fuchs et al. | 252/62.54 |

FOREIGN PATENT DOCUMENTS

WO WO 2009/037924 A1 3/2009

OTHER PUBLICATIONS

Lu, C. P., H. Gao et al. (2009). Ultra-precision machining technology of the soft and brittle functional crystal. *Msec 2008: Proceedings of the Asme International Manufacturing Science and Engineering Conference* 2008, vol. 1. New York: Amer Soc Mechanical Engineers: 669-676.

(Continued)

*Primary Examiner* — Gregory Webb
(74) *Attorney, Agent, or Firm* — Kilpatrick Townsend & Stockton

(57) ABSTRACT

A nonaqueous magnetorheological fluid includes a primarily organic carrier liquid and magnetizable particles. The magnetorheological fluid also includes a buffer, a stabilizer, and water. A pH of the magnetorheological fluid is between 6.5 and 9.0.

19 Claims, 10 Drawing Sheets

(56) References Cited

OTHER PUBLICATIONS

Menapace, J. A., P. R. Ehrmann et al. (2009). "Magnetorheological finishing (MRF) of potassium dihydrogen phosphate (KDP) crystals: nonaqueous fluids development, optical finish, and laser damage performance at 1064 nm and 532 nm." *Proceedings of the SPIE—The International Society for Optical Engineering* 7054: 750414.

Jacobs, S. D. (2007). "Manipulating mechanics and chemistry in precision optics finishing." *Science and Technology of Advanced Materials* 8 (3): 153-157.

Miao, C., K. M. Bristol et al. (2007). "Magnetorheological fluid template for basic studies of mechanical-chemical effects during polishing." *Proceedings of the SPIE—The International Society for Optical Engineering* 6671: 667110.

Balau, O., D. Bica et al. (2002). "Rheological and magnetorheological behaviour of some magnetic fluids on polar and nonpolar carrier liquids." *International Journal of Modern Physics B* 16 (17-18): 2765-2771.

Vekas, L., D. Bica et al. (2002). Concentration and composition dependence of rheological and magnetorheological properties of some magnetic fluids. *Adsorption and Nanostructures*. I. Dekany. Berlin: Springer-Verlag Berlin. Progress in Colloid and Polymer Science, vol. 117: 104-109.

Shorey, A. B., S. D. Jacobs et al. (2001). "Experiments and observations regarding the mechanisms of glass removal in magnetorheological finishing." *Applied Optics* 40 (1): 20-33.

Jacobs, S. D. and A. B. Shorey (2000). Magnetorheological finishing: new fluids for new materials. *Trends in Optics and Photonics. Optical Fabrication and Testing*. vol. 42. *Technical Digest. Postconference Edition*: Optical Society of America: 142-144.

Arrasmith, S. R., I. A. Kozhinova et al. (1999). "Details of the polishing spot in magnetorheological finishing (MRF)." *Proceedings of the SPIE—The International Society for Optical Engineering* 3782: 92-100.

Arrasmith, S. R., S. D. Jacobs et al. (1999). Studies of Material Removal in Magnetorheological Finishing (MRF) from Polishing Spots. *Finishing of Advanced Ceramics and Glasses*. R. Sabia, V. A. Greenhut et al: American Ceramic Society. Ceramic Transactions vol. 102: 201-210.

Jacobs, S. D. and S. R. Arrasmith (1999). "Development of new magnetorheological fluids for polishing CaF2 and KDP." *LLE Review* 80: 213-219.

Shorey, A. B., L. L. Gregg et al. (1999). "Study of material removal during magnetorheological finishing (MRF)." *Proceedings of the SPIE—The International Society for Optical Engineering* 3782: 101-111.

Jacobs, S. D., Y. Fuqian et al. (1997). "Magnetorheological finishing of IR materials." *Proceedings of the SPIE—The International Society for Optical Engineering* 3134: 258-269.

* cited by examiner

METHOD AND SYSTEM FOR POLISHING MATERIALS USING A NONAQUEOUS MAGNETORHEOLOGICAL FLUID

CROSS-REFERENCES TO RELATED APPLICATIONS

This application claims priority to U.S. Provisional Patent Application No. 61/331,948, filed on May 6, 2010, entitled "Nonaqueous Magnetorheological Fluid for Polishing KDP, ADP, and Other Water-Soluble and Structurally Sensitive Optical Crystals," the disclosure of which is hereby incorporated by reference in its entirety for all purposes.

STATEMENT AS TO RIGHTS TO INVENTIONS MADE UNDER FEDERALLY SPONSORED RESEARCH OR DEVELOPMENT

The United States Government has rights in this invention pursuant to Contract No. DE-AC52-07NA27344 between the U.S. Department of Energy and Lawrence Livermore National Security, LLC, for the operation of Lawrence Livermore National Laboratory.

BACKGROUND OF THE INVENTION

Optically finished single crystals in the potassium dihydrogen phosphate (KDP) family are a class of specialty optics used in solid-state laser systems as optical frequency conversion and polarization-based electro-optical switching media. Crystals in the KDP family are currently finished using single-point diamond turning (SPDT) tools. KDP optics fabricated using SPDT, however, are limited to surface corrections due to tool/method characteristics with surface quality driven by micro-roughness from machine pitch, speed, force, and diamond tool character. Mounting fixture and SPDT tool marks can also be problematic in these single crystal optics, particularly when used in high-fluence laser applications, since they can include a set of surface flaws that can damage and limit the optic's usable life.

Thus, there is a need in the art for improved methods and systems for polishing optical elements in the KDP family.

SUMMARY OF THE INVENTION

According to the present invention, techniques related to optical systems are provided. More particularly, embodiments of the present invention relate to methods and systems for polishing and/or finishing optical elements utilizing a nonaqueous magnetorheological finishing (MRF) fluid. Merely by way of example, the invention is applied to an MRF fluid capable of polishing a family of single crystal optics including KDP, deuterated KDP, and ADP. The methods and systems described herein are also applicable to processing and finishing of other optical systems using deterministic MRF tools and techniques.

Embodiments of the present invention provide specialized MR fluids useful for polishing KDP and other crystals. KDP is an extremely difficult material to conventionally polish due to its water solubility, low hardness, and temperature sensitivity. MRF polishing, which circumvents issues associated with conventional polishing techniques, is deterministic, low force, and temperature independent. Thus, MRF polishing is practical for surface as well as transmitted wavefront correction. Embodiments of the present invention provide a usable nonaqueous MR fluid that is chemically and physically compatible with KDP and can be used for polishing the KDP crystal and then subsequently cleaned from the optical surface. Utilizing the methods and system described herein, KDP crystals with improved laser damage performance at 1064 nm and 532 nm are produced.

According to an embodiment of the present invention, a nonaqueous magnetorheological fluid is provided. The nonaqueous magnetorheological fluid includes a primarily organic carrier liquid substantially free of water and magnetizable particles. The magnetorheological fluid also includes a buffer, a stabilizer, and water. A pH of the magnetorheological fluid is between 6.5 and 9.0.

According to another embodiment of the present invention, a fluid for magnetorheological finishing processes is provided. The fluid includes an anhydrous carrier liquid and a plurality of magnetizable particles supported in the carrier liquid. The fluid also includes a polar stabilizer supported in the carrier liquid and a buffer liquid supported in the carrier liquid operable to modify a pH of the fluid. The fluid further includes water supported in the carrier liquid. The fluid includes between 0.1% and 2.0% by weight of water.

According to a specific embodiment of the present invention, a method of polishing a KDP crystal having a surface is provided. The method includes forming an optical surface on the surface of the KDP crystal and forming a polished surface on the KDP crystal using MRF with an MR fluid. The MR fluid includes a carrier liquid and magnetizable particles supported in the carrier liquid. The MR fluid also includes a stabilizer supported in the carrier liquid, a buffer supported in the carrier liquid, and water. The MR fluid includes between 0.1% and 2.0% by weight of water.

Embodiments of the present invention provide a nonaqueous MR fluid specifically tailored for MRF polishing of KDP crystal surfaces and compatible with both the magnetically active environment and the physical and chemical properties peculiar to KDP. The nonaqueous carrier liquids that form the basis of the MR fluids as described herein are able to support dissolved KDP and/or water to prevent the KDP removed from the crystal surface during polishing from re-depositing back onto the crystal surface. Stabilizers are used in the MR fluid to protect the magnetizable particles (e.g., carbonyl iron) and the KDP crystal from reactions leading to fluid instability and particle agglomeration, which can produce a poor surface finish due to artifacts including polishing induced scratches and digs. The pH of the MR fluid is maintained between values of 6.5-9.0 in order to reduce or eliminate MR fluid oxidation, particle agglomeration, and uncontrollable KDP dissolution via acid-base reactions in which significant quantities of $PO_4^{-3}$ are produced.

According to embodiments of the present invention the performance of the MR fluid is optimized by adjusting the carrier liquid content of the MR fluid to produce mid-Å level micro-roughness on the KDP surfaces.

Numerous benefits are achieved by way of the present invention over conventional techniques. For example, embodiments of the present invention provide a nonaqueous MR fluid useful for polishing KDP, deuterated KDP, and ADP single crystal optics using deterministic MRF tools and techniques. The MR fluid described herein enables improved optical figure and finish when used in MRF tools in comparison to SPDT finishing processes. Moreover, methods and systems using the nonaqueous MR fluid described herein form optical elements characterized by improved high-intensity/high-power laser damage performance. Additionally, the MR fluid described herein is also applicable to methods and systems for deterministically polishing other water-sensitive and structurally weak crystals and glasses used in laser systems, communication devices, medical devices, optoelectronic systems, sensors, displays, probes, and the like. These and other embodiments of the invention along with many of its advantages and features are described in more detail in conjunction with the text below and attached figures.

DETAILED DESCRIPTION OF SPECIFIC EMBODIMENTS

Figure 1:
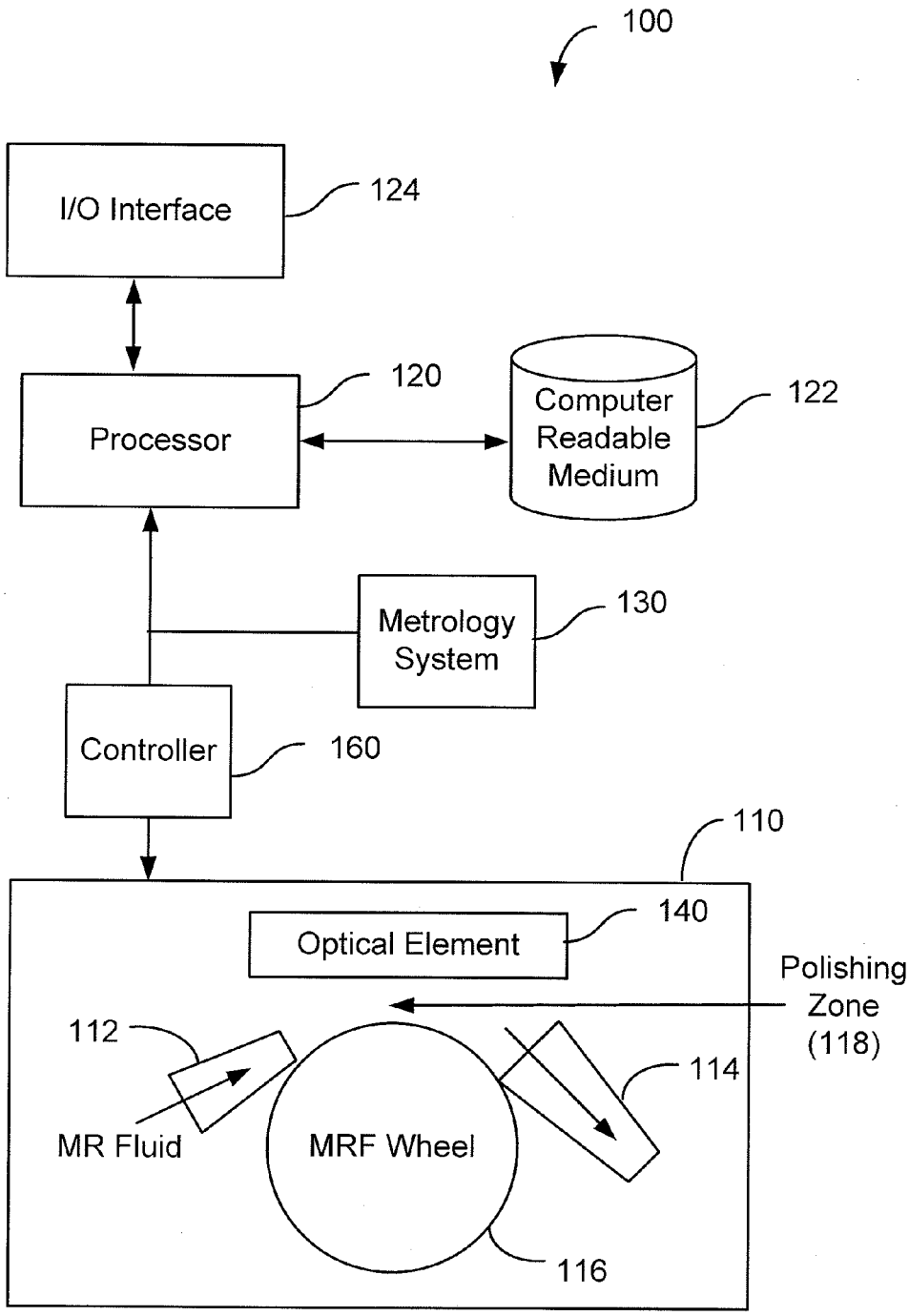
FIG. 1 is a simplified schematic diagram of an MRF optical polishing system according to an embodiment of the present invention.

According to embodiments of the present invention, magnetorheological finishing (MRF) polishing techniques are utilized to finish optical elements. MRF is a deterministic, low force, and temperature independent polishing technique that is useful for surface finishing as well as transmitted wavefront correction. Embodiments of the present invention provide magnetorheological (MR) fluids utilizing a "nonaqueous" carrier liquid so that the MR fluid is chemically and physically compatible with the family of KDP and ADP crystals during polishing and can be subsequently cleaned from the optical element.

Previous attempts to use MRF to polish KDP have met with limited success and were not able to use MRF to adequately and consistently polish KDP surfaces and subsequently clean the KDP. Dicarboxylic acid ester carrier fluids, although compatible with KDP in neat form over a short time interval, react with KDP and carbonyl iron. Dicarboxylic acid ester carrier fluids also undergo reaction at moderate to high pH to yield dicarboxylic acids and alcohols according to equation 1.

(1)

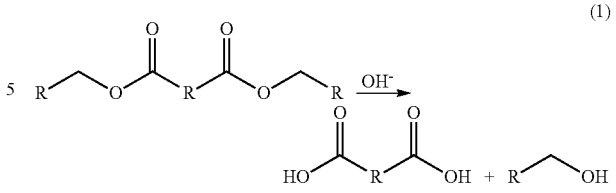

Alcoholic products, containing four or less carbons, cause staining of KDP via dissolution reactions, water absorption, and evaporation. Additionally, the dicarboxylic acid products are bidentate species that can react with the carbonyl iron spheres to create a coating around the spheres. The dicarboxylic acid products can further react with KDP through acid-base reactions. An important complication is that the spheres become incompatible with the carrier fluid because of improper stabilization and agglomerate, resulting in scratching, pitting, and staining of the KDP during polishing and cleaning steps.

Optically finished single crystals in the KDP family presents unique challenges to the processes required to fabricate ultra-precision optical elements, particularly those used in the high-fluence environments of Megajoule-class inertial confinement fusion (ICF) laser systems. KDP crystals are extremely difficult to grow, especially in large sizes of ~60 cm on edge, due to the introduction of internal lattice imperfections that affect material performance and optical wavefront characteristics. Furthermore, once high-aspect ratio (40:1, or better) optical plates are harvested from single crystal boules, polishing is difficult to accomplish using conventional pitch-lapping techniques. KDP optics are very soft (Mohs hardness of 2.5), thermally sensitive, prone to fracture, and easily scratched. KDP has a further complication in that it is hygroscopic and extremely water soluble (33 g per 100 ml). Thus, conventional aqueous polishing techniques are unsuitable for polishing KDP.

SPDT techniques are used to polish KDP, however, SPDT, by design, is limited to producing a flat surface on each of the KDP optical faces, which results in having to select a crystal blank having bulk homogeneity properties adequate for production of an acceptable final optic. SPDT does not provide for correction of bulk crystal inhomogeneities that are present in the final optic, thereby impacting the resulting wavefront. Investigations have been performed in conventional lapping and ultra-precision grinding techniques in an attempt to provide alternatives to SPDT to produce super-polished single crystal KDP surfaces. These techniques, however, have produced optics with embedded abrasives and contamination that are difficult, if not impossible, to remove.

Advanced MRF technology has been utilized in embodiments of the present invention to finish water-soluble KDP crystals with optical properties superior to what is currently available. Although embodiments of the present invention are discussed in relation to KDP, the present invention is not limited to polishing of KDP crystals and other water-soluble media are included within the scope of the present invention. Examples of other water-soluble materials to which embodiments of the present invention can be applied are ADP crystals, deuterated KDP (DKDP) crystals, rubidium dihydrogen phosphate crystals, cesium dihyogren phosphate crystals, alkali halides such as lithium iodate crystals, cesium iodide crystals, potassium bromide crystals, potassium chloride crystals, sodium chloride crystals, barium fluoride crystals, calcium fluoride crystals, and the like.

MRF is a deterministic polishing process in that the end result can be predicted and repeatedly achieved. Product quality and repeatability is easily attained using MRF while providing a quantum leap in throughput, productivity, yield, and cost effectiveness. Embodiments of the present invention provide nonaqueous MR fluids that are suitable for polishing KDP and are characterized by several parameters, such as pH, water content, the interaction of the carrier with carbonyl iron media and the crystal substrate, and the like. Embodiments of the present invention provide methods and systems for MRF polishing of KDP surfaces using an MR fluid that is chemically and physically compatible with KDP to form an adequately and consistently polished surface that can then be subsequently cleaned.

The inventors have determined the fluid parameters important in the design of nonaqueous MR fluid formulations suitable for polishing KDP and the impact these parameters have on optical figure/finish achieved by MRF polishing and subsequent cleaning. The nonaqueous MR fluid parameters or characteristics addressed in this application are: 1) carrier liquid type, 2) fluid stabilizer compatibility, 3) intentional or environmental water content, 4) carrier liquid content, and 5) fluid pH. Embodiments of the present invention are not limited to these particular parameters, which are discussed by way of example. Utilizing embodiments of the present invention, KDP samples were polishing using MRF and laser damage performance analyzed at 1064 nm and 532 nm.

In contrast with aqueous MR fluids, the nonaqueous MR fluids discussed herein are nonaqueous in the sense that although the MR fluid contains a predetermined amount of water, the MR fluid is primarily organic, which is a definition of nonaqueous. The term nonaqueous is used in the sense that the MR fluid is primarily organic based on weight percentages of water in comparison with other constituents of the MR fluid. As described more fully throughout the present specification, the weight percentage of water in the MR fluid is less than 2% and typically used at less than 1% by both weight and volume. The majority of the weight of the MR fluid results from the high density of the magnetizable particles (e.g., iron carbonyl). In particular embodiments, the carrier liquid is substantially free of water and water is added to the MR fluid to perform the function of an abrasive. In contrast with previous attempts to polish KDP with anhydrous MR fluids intentionally lacking all water, the MR fluids described herein utilize the extreme water solubility of KDP as part of the polishing process. A predetermined amount of water is added to the MR fluid as a solvating species that works in conjunction with other anhydrous components of the MR fluid to perform chemomechanical polishing.

Additional description of nonaqueous MR fluids suitable for MRF polishing of KDP are provided in "Magnetorheological finishing (MRF) of potassium dihydrogen phosphate (KDP) crystals: nonaqueous fluids development, optical finish, and laser damage performance at 1064 nm and 532 nm," J. A. Menapace, P. R. Ehrmann, and R. C. Bickel, Proc. SPIE 7504, 750414 (2009), the disclosure of which is hereby incorporated by reference in its entirety for all purposes.

FIG. 1 is a simplified schematic diagram of an optical element processing system according to an embodiment of the present invention. The MRF system 100 includes an MRF polishing tool 110 with enhanced capabilities in comparison to conventional tools. The MRF polishing tool 110 includes an MRF wheel 116. MR fluid is provided through fluid inlet 112 and forms a ribbon on the MRF wheel 116 in the polishing zone 118. After passing through the magnetic field in the polishing zone 118, the MR fluid is collected in fluid outlet 114 and recirculated to the fluid inlet 112 using a pump (not shown). The optical element 140 moves with respect to the MRF wheel 116, for example, in a raster scan, circular, or other pattern to polish the surface of the optical element 140.

The MRF system also includes an I/O interface 124 that enables a user to program the MRF tool and interact with other system elements. The MRF system has a processor 120 that is used to perform calculations related to dwell times and other system parameters. A computer readable medium 122 (also referred to as a database or a memory) is coupled to the processor 120 in order to store data used by the processor and other system elements. The processor 120 interacts with a metrology system 130, which provides data on the surface structure of the optical element as well as the internal non-uniformities inside the optical element. Typically, the metrology system 130 includes an interferometer that provides spatially resolved phase information for the optical element. Using the processor 120, the memory 122, and the I/O interface 124, a user is able to calculate the system parameters and dwell time for the optical element to form a predetermined shape on the optical element. The controller 160 interacts with the MRF tool 110 to accomplish the deterministic polishing process.

The processor 120 can be a general purpose microprocessor configured to execute instructions and data, such as a Pentium processor manufactured by the Intel Corporation of Santa Clara, Calif. It can also be an Application Specific Integrated Circuit (ASIC) that embodies at least part of the instructions for performing the method in accordance with the present invention in software, firmware and/or hardware. As an example, such processors include dedicated circuitry, ASICs, combinatorial logic, other programmable processors, combinations thereof, and the like.

The memory 122 can be local or distributed as appropriate to the particular application. Memory 512 may include a number of memories including a main random access memory (RAM) for storage of instructions and data during program execution and a read only memory (ROM) in which fixed instructions are stored. Thus, memory 512 provides persistent (non-volatile) storage for program and data files, and may include a hard disk drive, flash memory, a floppy disk drive along with associated removable media, a Compact Disk Read Only Memory (CD-ROM) drive, an optical drive, removable media cartridges, and other like storage media. Additional description related to MRF systems and MRF polishing techniques is provided in commonly assigned and copending U.S. patent application Ser. No. 12/760,418, filed on Apr. 14, 2010, and entitled "Method and System for Processing Optical Elements Using Magnetorheological Finishing," the disclosure of which is hereby incorporated by reference in its entirety.

Figure 2:
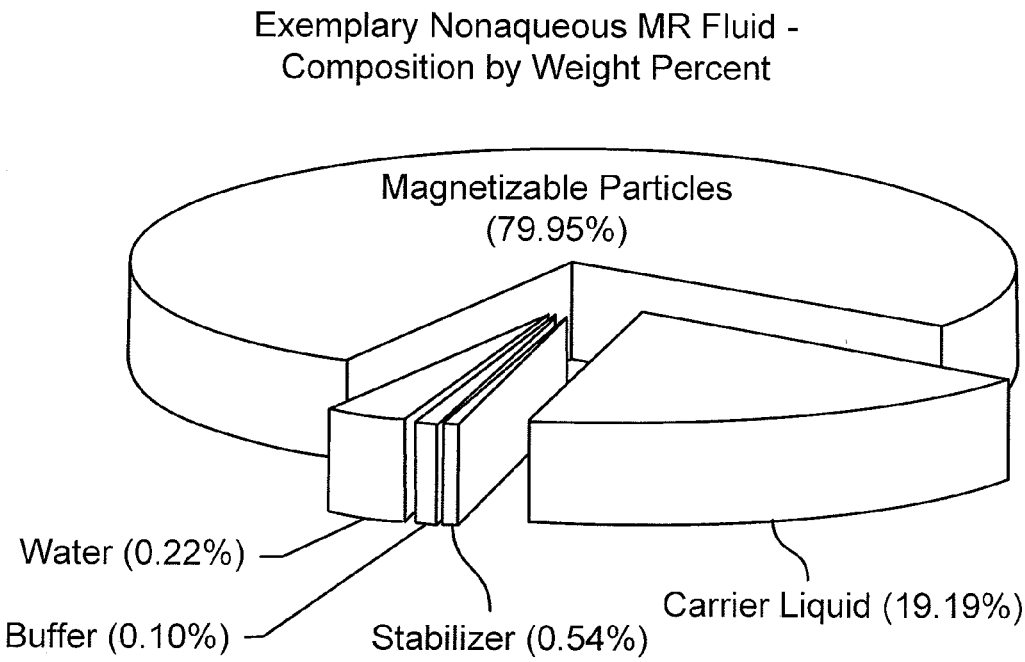
FIG. 2 is a chart illustrating composition of a nonaqueous MR fluid according to an embodiment of the present invention.

FIG. 2 is a chart illustrating composition of a nonaqueous MR fluid according to an embodiment of the present invention. The nonaqueous MR fluid illustrated in FIG. 2 is a non-colloidal suspension of 1-5 μm diameter magnetizable particles (e.g., carbonyl iron spheres) in a carrier liquid. The magnetizable particles in embodiments using carbonyl iron spheres are manufactured via thermal decomposition of iron pentacarbonyl into species known as carbonyl iron powder or spheres. The particles are magnetically polydomain, i.e., they possess no overall intrinsic magnetic moment. However, the particles can attain large magnetic moments when placed into a magnetic field, which leads to the alignment of the particles into long columns or chains. This alignment is responsible for the rheological activity of the fluid, namely its yield strength and viscosity. These characteristics make the fluid media amenable to MRF polishing. The carbonyl iron spheres are manufactured in a variety of grades and sizes of which the "soft" grade (reduced under hydrogen atmosphere) of 3 μm average particle size is preferable for optical polishing applications.

The carbonyl iron spheres provide the backbone of the MRF removal function, or polishing spot, under the influence of a magnetic field in the MRF polishing zone, and an abrasive or chemomechanical agent in the fluid performs polishing. Although carbonyl iron spheres are utilized in some embodiments described herein, the present invention is not limited to the use of carbonyl iron and other magnetizable particles including other iron analogues can be used in alternative embodiments. One of ordinary skill in the art would recognize many variations, modifications, and alternatives.

According to embodiments of the present invention, nonaqueous MR fluids suitable for polishing KDP and formulations containing components that are compatible with KDP, the MRF process, and the MRF tool are provided. In an exemplary embodiment, the components of the nonaqueous MR fluid include an anhydrous carrier liquid, carbonyl iron spheres, water, a stabilizer, and a chemical buffer. In general, the fluid formulations contain organic carrier liquids and organic and inorganic stabilizers of particular use in MRF polishing of KDP.

The carrier liquid for KDP MRF polishing is preferably either nonvolatile or characterized by low volatility, since it is hydrocarbon based. Preferably, it is nonflammable at room temperature with a high flash point, resistant to a potentially corrosive environment, unreactive with the carbonyl iron, KDP, and MRF machine components, have low or no toxicity, a viscosity in the range of 10-20 cP, and incapable of dissolving or adversely affecting the optical surface of KDP single crystal optics.

It should be noted that dicarboxylic acid esters, which have been used in MRF finishing, long chain alcohols, and long chain alkoxy alcohols are potential carrier liquids.

Long chain alcohol carrier liquids, like dicarboxylic acid esters, are compatible with KDP in neat form as long as the organic chain length is four carbons or greater. Shorter carbon length alcohols lead to rapid evaporation and water condensation on the crystal, resulting in staining during polishing and optic cleanup. There is also a potential of flammability for these species since vapor pressures can be high. Longer carbon chain length alcohols tend to become very hydrophobic which makes optic and MRF tool cleanup difficult. They are, however stable at moderate pH values, making them compatible with the carbonyl iron.

Polyfunctional compounds, such as alkoxy alcohols with a chemical structure illustrated in equation 2, represent a class of organic compounds that have both hydrophilic and hydrophobic functional groups, thereby making them compatible with both hydrocarbon and aqueous solvents. The hydrocarbon chains promote solubility in hydrocarbon solvents. The alkoxy and alcohol functional groups provide solubility in water via hydrogen bonding. As a nonaqueous MR carrier liquid, these compounds have little to no volatility and are inert to reactions with KDP and carbonyl iron. They are also stable in moderately acidic and basic environments. Crystal cleanup after polishing can be readily accomplished by rinsing with the liquid in neat form followed by rinsing with toluene or xylene. They have no effect on the MRF components and the MRF tool can be cleaned using soap and water in a fashion similar to that used in aqueous MR fluid systems.

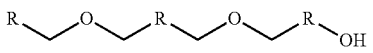

(2)

Embodiments of the present invention utilize stabilizers as a component of the nonaqueous MR fluids to minimize interaction between the magnetic particles. The carbonyl iron particle surfaces are highly polar and contain several functional groups that can interact through van der Waals forces, electrostatic forces, or combine via chemical reaction when placed into a carrier liquid leading to flocculation or agglomeration. In severe cases, the MR fluid separates into distinct phases containing large particle aggregates and carrier liquid. For nonaqueous MR systems, the carrier liquids are sufficiently nonpolar and do not protect the carbonyl iron particles from directly contacting and reacting. From the MRF polishing standpoint, this results in an undesirable response in the MRF system ranging from instabilities in the MRF removal function to scratching of optical surfaces.

MR stabilizers, also referred to as coupling agents, are typically long chain polar molecules with polar carboxyl, hydroxyl, or amino functional groups located on one end and nonpolar hydrocarbon groups at the other. Common examples of MR stabilizers are oleic or stearic acid. Addition of a stabilizer to the MR fluid results in chemical or physical bonding between the stabilizer's polar end and the carbonyl iron particle surface, thereby forming a tightly bound monolayer around each particle. This monolayer protects the particles from interacting through steric repulsion. Since the long stabilizer chain fragment resembles the polarity of the carrier liquid, the carrier liquid is able to form a solvation boundary around this monolayer further protecting the particles from interaction. In short, MR stabilizers bond with the carbonyl iron particles in the fluid making them compatible with the carrier and neighboring particles. Preferably, complete monolayer coverage of each particle is realized, leading to optimal performance of the stabilized fluid. In some implementations, an excess amount of stabilizer in the MR fluid impacts the viscosity of the system. A geometric model can be used to estimate the amount of stabilizer needed to create a monolayer around the carbonyl iron present in the fluids expressed at a weight ratio, $k_{wt}$, of carbonyl iron to stabilizer based upon the carbonyl iron particle diameter, $d_{ci}$, the length of the stabilizer chain, $d_{st}$, and the densities of the carbonyl iron $\rho_{ci}$, and stabilizer, $\rho_{st}$ (equation 3).

$$k_{wt} = \frac{\rho_{ci} d_{ci}^3}{\rho_{st}((d_{ci} + 2d_{st})^3 - d_{ci}^3)} \tag{3}$$

Embodiments of the present invention utilize water as an abrasive component of the nonaqueous MR fluid. KDP solubility in water at room temperature is a function of pH, running from 33 g per 100 grams water at pH~5 to a four-fold increase at pH~8.4. Because of the solubility of KDP in water, the inventors studied the condensation of water and atmospheric absorption of water in carrier liquids and MR fluids in relation to the KDP MRF polishing process. The ability to design and use a nonaqueous MR fluid useful in a sub-aperture polishing process like MRF is impacted by the high solubility of KDP in water and environmental water absorption was studied accordingly. MR carrier liquid residues are generally present on areas of an optic that have been polished and remain there until the entire surface has passed under the MRF removal function.

In KDP MRF polishing studies using anhydrous MR fluids, the inventors determined that the anhydrous MR fluids could not support the KDP that was removed from the crystal surface during polishing. In fact, the KDP removed from the crystal surface precipitated and re-crystallized in areas within the MRF polishing zone. The re-crystallized KDP forms measurable deposits and sleeking. The sleeking indicates that the precipitation occurs during polishing while the material is still within the removal function boundary as opposed to at a later time when the area simply contains fluid residue from previous sub-aperture MRF polishing. Furthermore, the deposits attach to the crystal surface and become part of the crystal, making them difficult or impossible to remove. Scanning electronic microscopy X-ray analysis performed on KDP samples confirmed that the deposits were KDP, $K_2HP$, or $K_3P$. The inventors believe, without limiting embodiments of the present invention, that the fact that an anhydrous MR fluid has no solubility for KDP contributes to the observed KDP re-crystallization onto the crystal surface. Of note, the inventors have related this behavior to the near room temperature, supersaturated solution crystallization process associated with KDP growth.

According to embodiments of the present invention, a predetermined (e.g., a few weight percent) amount of water is added to the nonaqueous MR fluid to reduce or eliminate KDP precipitation. As such, the water is a component in the nonaqueous MR fluid formulations for KDP polishing. The inventors have determined that some embodiments of the nonaqueous MR fluid can contain up 2.00% water by weight without deteriorating the crystal surface quality. According to embodiments of the present invention, the MR fluid contains between about 0.1% and about 2.0% water by weight. The lower bound of the water content can be defined by the environmental absorption of water from the atmosphere, which will depend on the temperature and humidity of the environment in which the MRF polishing techniques are performed. According to some embodiments of the present invention, the water content is greater than that resulting from environmental absorption and is controlled to provide the desired amount of abrasive in the MR fluid. One of ordinary skill in the art would recognize many variations, modifications, and alternatives.

Figure 3:
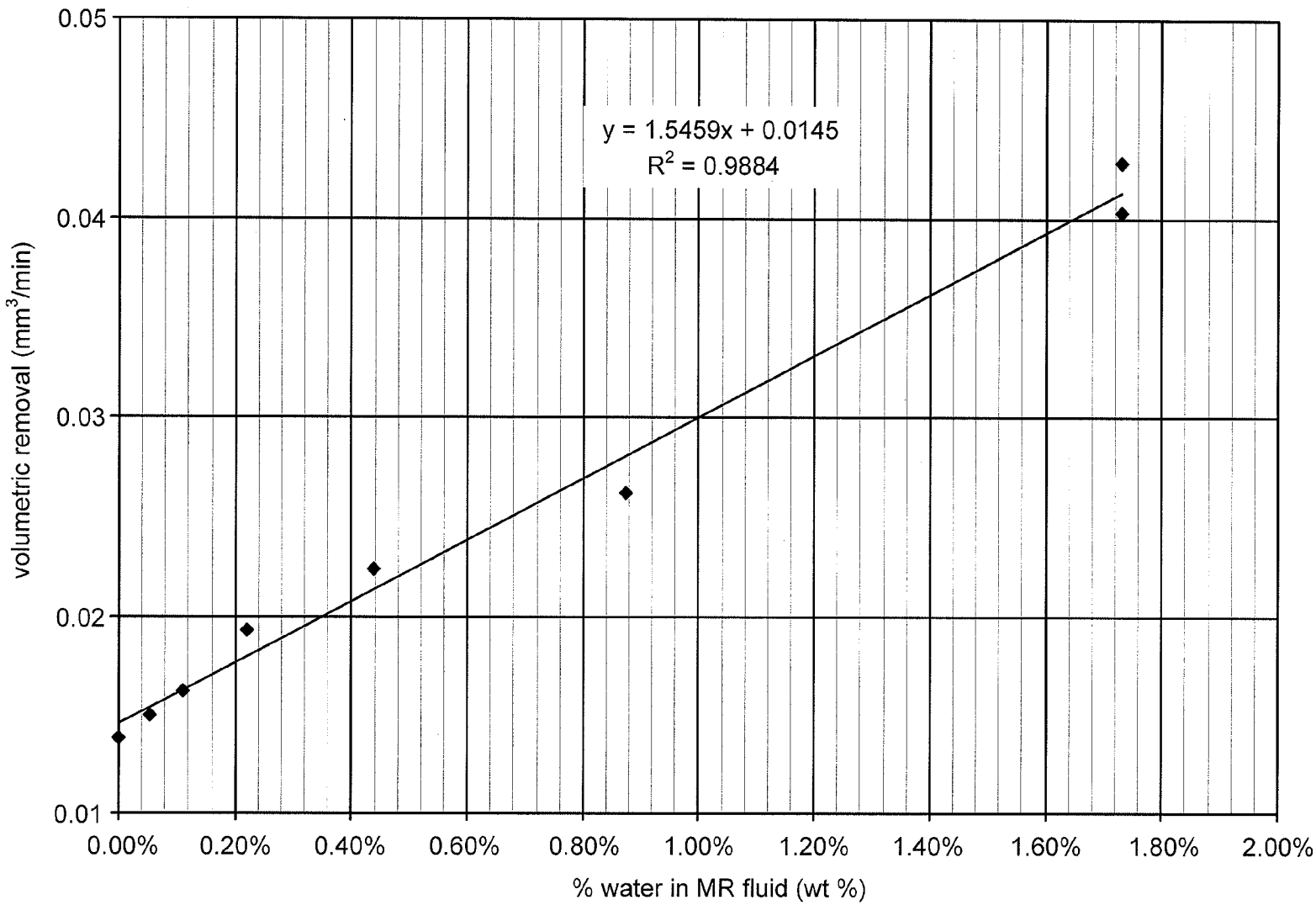
FIG. 3 is a plot showing volumetric removal rate of KDP as a function of water content of the nonaqueous MR fluid according to an embodiment of the present invention.

FIG. 3 is a plot showing volumetric removal rate of KDP as a function of water content of the nonaqueous MR fluid according to an embodiment of the present invention. The plot in FIG. 3 illustrates that the water content in the nonaqueous MR fluid influences the MRF volumetric material removal rate in a controllable and predictable manner within the KDP polishing operating bandwidth. Water at these low levels is miscible in the carrier liquid and thus not available to concentrate on the KDP surface. Since the MR fluid has low volatility, there is also little risk of water concentration due to fluid evaporation, which can be associated with the use of short carbon chain alcohols as the carrier liquid. The high solubility of KDP in water, particularly at moderate pH, enables a low water content in the MR fluid while still maintaining the ability of the fluid to function without promoting precipitation. For example, a nonaqueous MR fluid containing 8.4 grams of water (~0.22%) per 3 kilograms of carbonyl iron would be capable of supporting 10.5 grams of KDP. In polishing terms, this amounts to 4.5 $cm^3$ of KDP that can be removed using the MR fluid. For a 43 cm×43 cm crystal plate, this equates to 24 μm of material removal, which is a factor of 10 greater than that utilized to perform damage removal and figure correction. If the MRF process is only used for figure correction, the factor approaches 30.

The use of water as a component in the nonaqueous MR fluid also enhances the peak and volumetric removal rates derived from the MRF removal function. Within the water content operating envelope of 0.1% to 2.0% water, the volumetric removal rate linearly increases by about a factor of 4 with peak removal linearly increasing by a factor of 2. These removal rates are similar to the rates obtained on MRF polished fused silica using aqueous MRF fluids and a 50 mm MRF wheel. Beyond 2.0% water, the MRF removal function can begin to become uncontrollable with increasing nonlinear removal rate behavior and the crystal surfaces can begin to sleek and scratch due to significant interaction/dissolution of the KDP and entrapment of carbonyl iron particles at the polishing zone/crystal interface.

According to some embodiments of the present invention, the amount of carrier liquid in the MR fluid is a parameter that is controlled and held constant during the course of an MRF polishing run. The liquid content of the MR fluid largely establishes the plastic viscosity of the fluid system, and thereby, sets the shear stress within the MRF removal function that is responsible for polishing action when an optic is immersed into the magnetically modified MR ribbon moving at the rotational speed of the MRF wheel. In an aqueous MR fluid system, fluid content is controlled by viscosity computed from the flow rate and pressure monitored in the MR fluid by adding water drop-wise to the mixing tank if the viscosity is too high. Evaporation of water from the fluid occurs continuously and is used to increase the viscosity of the fluid if necessary by slowing or stopping water addition. This can be a source of polishing error, particularly during long MRF polishing runs, since the evaporation characteristics of the system change when an optic is immersed into the MR ribbon. During polishing, the increased surface area of the ribbon in the polishing zone and the extraction of water from the ribbon onto the optic can lead to evaporation rate changes that alter the removal function's properties if the MRF system viscosity feedback is not tightly controlled and quick enough to respond.

In contrast, the low volatility of the carrier fluid utilized in the nonaqueous MR fluids described herein maintains the plastic viscosity of the fluid at the value established by the liquid content used during preparation, which results in a very stable environment for polishing. A typical viscosity change on these systems is about 1-3% over a three week period. The low volatility of the carrier and the stability in the system is advantageous because viscosity control is not typically an issue and carrier fluid addition is not typically necessary. The carrier liquid content can be increased, and fluid plastic viscosity decreased, by simply adding additional carrier liquid to the MRF system mixing tank. Reducing the liquid content, or increasing the viscosity, is more difficult in some implementations and may require the addition of high viscosity carbonyl iron/carrier liquid mixtures in the appropriate amount.

Figure 4:
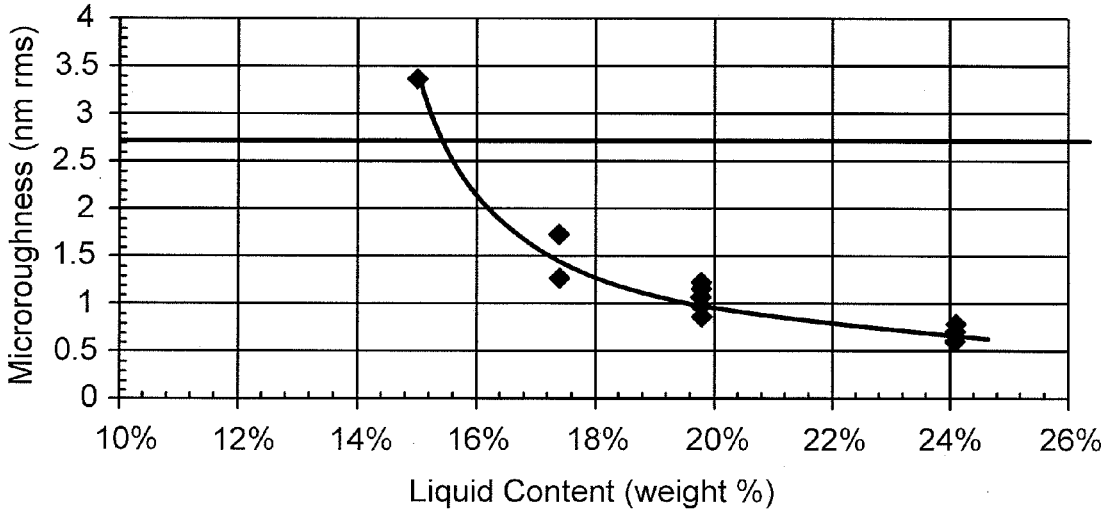
FIG. 4 is a plot showing micro-roughness as a function of liquid content of the nonaqueous MR fluid according to an embodiment of the present invention.

FIG. 4 is a plot showing micro-roughness as a function of liquid content of the nonaqueous MR fluid according to an embodiment of the present invention. The horizontal line at 2.7 nm corresponds to the initial roughness of the SPDT surface being polished. When used to polish KDP, the nonaqueous MR fluid's carrier liquid content plays a central role in the resulting surface micro-roughness. At the fluid/crystal interface, the MR fluid in the polishing zone is sheared with respect to the fluid core which is moving at the speed of the wheel (unsheared flow). This essentially sets up shear stress responsible for polishing as the material flows through the polishing zone. The depth of the sheared fluid volume is dependent upon the plastic viscosity of the fluid. If the viscosity is too high, the depth of this zone is small and the crystal experiences polishing from the unsheared liquid, resulting in increased surface roughness because of interaction with larger carbonyl iron agglomerates that are formed in the magnetically active zone. Increasing the liquid content of the MR fluid produces a depth increase in the sheared fluid volume, which reduces the surface roughness to the point where it is driven by the size distribution of the carbonyl iron particles.

Referring to FIG. 4, at 15 weight percent carrier fluid content, the resulting KDP surface micro-roughness is larger than that of the starting SPDT surface micro-roughness of 2.72 nm rms. This indicates that the overall fluid viscosity is too high for KDP polishing as large MR particles are contacting the crystal surface due to core impingement. As the carrier fluid content is increased towards 20 weight percent, the micro-roughness significantly improves and asymptotically approaches 0.65 nm rms at ~24 weight percent. Thus, embodiments of the present invention provide surface micro-roughness with mid- to high-Angstrom rms values. These results are similar to results observed on glasses, such as fused silica, polished with aqueous MR fluids. The inventors have demonstrated that SPDT lines present on the initial KDP surface are removed during MRF polishing and replaced by much shallower MRF lines arising from the unidirectional flow of the MR fluid in the polishing zone. Thus, according to embodiments of the present invention, the non-aqueous carrier liquid weight percent in the fluid is adjustable between 15 and 30 weight percent with respect to the carbonyl iron to achieve variable material removal rates and optimize surface roughness.

The pH of the MR fluid is controlled according to embodiments of the present invention during MRF polishing. As described herein, the pH of the MR fluid is maintained in an operating range to minimize or eliminate reaction of the carbonyl iron particles with the carrier liquid and optional abrasives used in addition to water. Furthermore, the operating pH is maintained such that the carrier liquid does not deteriorate over time from acid-base reaction with species present in the polishing media. All polishing media possess some form of conjugate acid-base characteristics due to the fact that the species present in the system contain hydrolyzed or oxidized surface groups created during preparation and/or exposure to the environment. These groups undergo acid-base reaction depending upon the pH of the MR fluid, leading to a net surface charge, or zeta potential, on the particles in the media. In acid form, the surface of the particles possesses a net positive charge due to the protonation of the hydrolyzed or oxidized surface groups and solvation by the carrier liquid. In base form, the particle surfaces have a net negative charge due to removal of protons by the basic environment.

In some embodiments, the pH of the MR fluid is biased towards the basic form for two reasons. First, the carbonyl iron particles undergo oxidation reactions (i.e., rust) at low pH (pH<6) yielding ferrous and ferric species that lead to particle agglomeration and settling. The large particle masses produce undesirable surface quality during MRF polishing in the form of scratches, pits, and the like. Additionally, iron particles can react with acid to yield $FeCl_2$. Second, a high pH environment promotes and maintains particle ionization, or negative zeta potential, resulting in electrostatic repulsion between particles that reduces or eliminates irreversible fluid agglomeration and scratching during polishing. For the non-aqueous MR fluids described herein, the conjugate acid-base behavior of the particle surfaces can be described by a simple single-equilibrium model with a $pK_a$ of 6.7 as determined by titration of the fluid with a standardized base. At pH 6.7, a 50:50 mix of acid and base forms are present in the MR fluid and by pH 8.5, nearly all of the species are converted to base form. The reaction is reversible within a pH range of 6.5-12.5 as determined by acid back titration. Furthermore, the reaction involves surface modification of the carbonyl iron particles as evidenced by the amount of species titrated compared to the total amount present (4 millimoles titrated versus 0.5 moles carbonyl iron present). Generally, the nonaqueous MR fluid is stable above pH 6.5.

Figure 5:
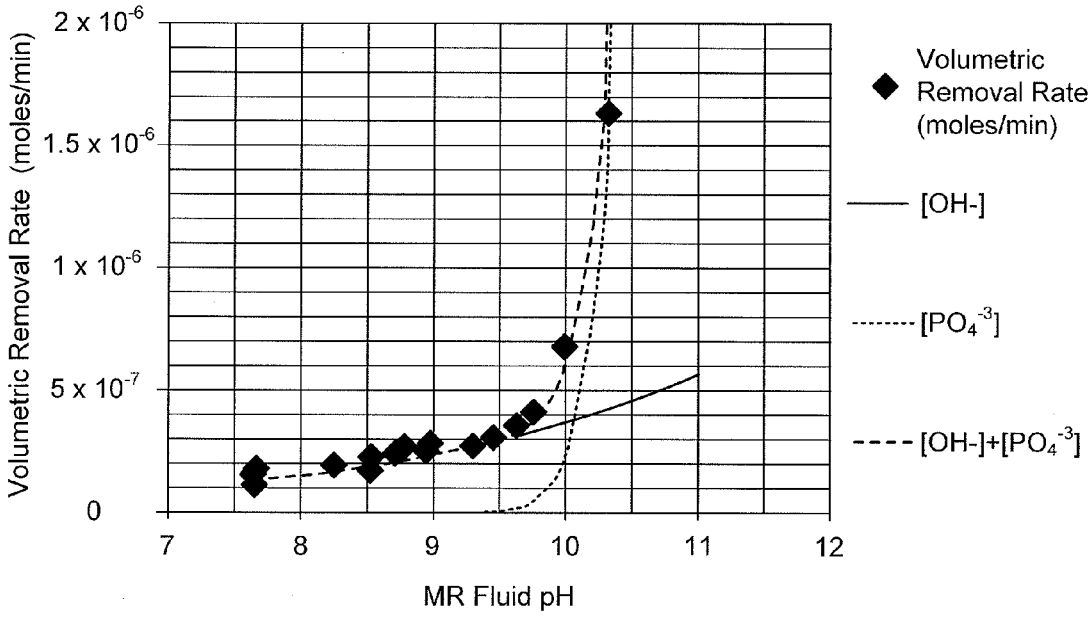
FIG. 5 is a plot of the KDP material removal rate as a function of MR fluid pH according to an embodiment of the present invention.

FIG. 5 is a plot of the KDP material removal rate as a function of MR fluid pH according to an embodiment of the present invention. FIG. 5 provides insight into an aspect of nonaqueous MR fluid pH that is of interest in relation to KDP crystal polishing, namely the solubility of KDP, or to be more exact, the solubility of the predominant conjugate acid-base species present in the MR fluid at a particular pH. In solution, KDP forms conjugate acid-base pairs that are variations of phosphoric acid species depending upon the pH environment present. At pH values above 6.5, for which the nonaqueous MR fluid is stable, the predominant species present in the MRF polishing zone is $HPO_4^{-2}$ or $PO_4^{-3}$. During studies to determine the usable pH range for MRF polishing, the inventors determined that material removal is controllable for MR fluid with a pH in the range from 6.5-9.5, with volumetric and peak removal rates increasing almost linearly with pH. At pH above 9.5, however, KDP material removal dramatically increases and the removal functions become difficult to control or uncontrollable. This is due to the formation of significant quantities of $PO_4^{-3}$ at the polishing interface. Without limiting embodiments of the present invention, the inventors believe that at pH values above 9, KDP dissolution at the polishing interface is sufficient to cause adhesion of MR fluid to the crystal surface, resulting in scratching during optic cleaning. Thus, in some embodiments of the present invention, the usable pH range for MRF polishing of KDP is restricted by the MR fluid stability and the KDP species present. For these embodiments, the usable pH range for KDP MRF polishing is pH 6.5-9.0. In other embodiments, other pH ranges are utilized.

Since KDP is inherently acidic with a solution pH of 4.3, the MR fluid pH will change during use. Consequently, the removal function characteristics change over time since KDP material removal is pH dependent as illustrated in FIG. 5. To reduce or eliminate the effects of pH change due to the amount of KDP added to the MR fluid over time, a buffer can be added to maintain the pH of the MR fluid at a predetermined value. KDP and potassium hydroxide are suitable buffering agents used to adjust the pH of the MR fluid. The function of these species as buffering agents is to drive the fluid to a predetermined pH state and prevent a change in this pH. The advantage of using these species in that the nonaqueous MR fluid lies in the fact that they contain ions common to those already present during polishing. According to an embodiment, a buffer pH target of pH 8.0 was used to center the working pH within the usable range of pH 6.5-9.0.

Referring once again to FIG. 2, an exemplary embodiment of the present invention provides a nonaqueous MR fluid including a carrier liquid, magnetizable particles, a buffer, a stabilizer, and water. In some embodiments, the pH of the MR fluid is between 6.5 and 9.0. The carrier fluid, which can be anhydrous or substantially free of water, can be 2-(2-butoxyethoxy) ethanol, 1-(2-butoxyethoxy) ethanol, other miscible mono- or poly-functional compounds containing alcohols, ethers, and/or carbonyl groups, diethyl malonate, 1-pentanol, dicarboxylic acid esters, long chain alcohols, other ether alcohols, arylalkoxy (aliphatic and/or aromatic) alcohols, combinations thereof, or the like. In some embodiments, the MR fluid includes between 15 and 30 weight percent of the carrier liquid. Thus, the exemplary embodiment illustrated in FIG. 2 includes 19.59% by weight of the carrier liquid although other weight percentages are within the scope of the present invention.

The magnetizable particles including in the MR fluid can be carbonyl iron or the like. The magnetizable particles are a predetermined percentage of the MR fluid by weight, for example, ranging from about 75% to about 85% by weight, for example, about 80%.

The buffer included in the MR fluid to maintain the desired pH can be one of several salt/base combinations. The buffer is selected as appropriate to the crystal material being polished. For example, when polishing KDP, the buffer can be KDP/KOH. When polishing deuterated KDP (i.e., DKDP), the deuterated derivatives of KDP/KOH can be used. When polishing ADP, ADP/KOH can be used as the buffer. One of ordinary skill in the art would recognize many variations, modifications, and alternatives. The weight percent of the buffer is a predetermined value, for example ranging from about 0.1% to 0.3% by weight. In a particular embodiment, the buffer is about 0.2% by weight of the MR fluid.

The stabilizer included in the MR fluid to reduce or eliminate the agglomeration of the magnetizable particles can be potassium oleate or other suitable stabilizers. In an embodiment, the weight percentage of the stabilizer in the MR fluid ranges from about 0.2% to 1.0% by weight. In a particular embodiment, the MR fluid includes about 0.6 weight % potassium oleate as the stabilizer.

As discussed above, water is utilized in the nonaqueous MR fluid as an abrasive and to enable support of the KDP removed from the surface of the optical element. In an exemplary embodiment, the MR fluid includes an amount of water ranging from about 0.1% to about 2.0% by weight, for example, 0.3% water by weight.

Figure 6A:
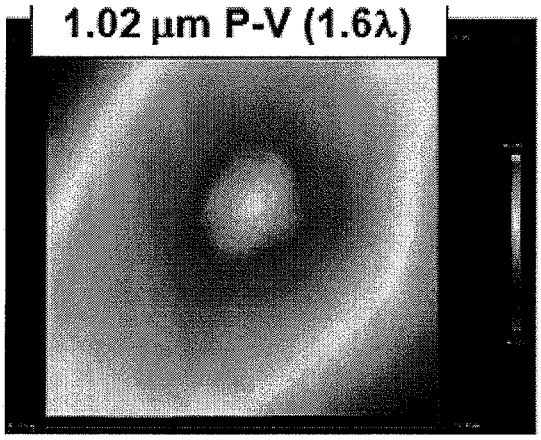
FIGS. 6A and 6C are interferograms of the surface of a first KDP crystal before and after MRF polishing using a nonaqueous MR fluid according to an embodiment of the present invention.
Figure 6B:
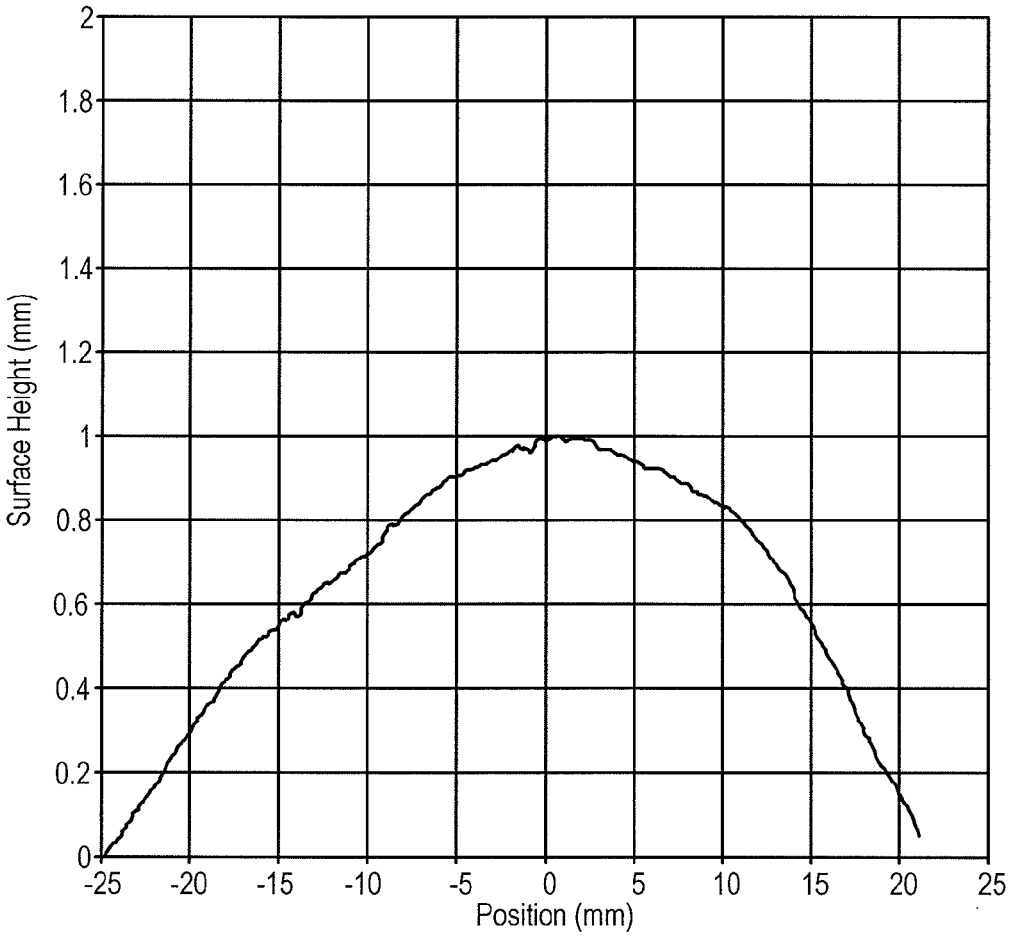
FIGS. 6B and 6D are plots illustrating surface height as a function of position for the interferograms illustrated in FIGS. 6A and 6C, respectively.
Figure 6C:
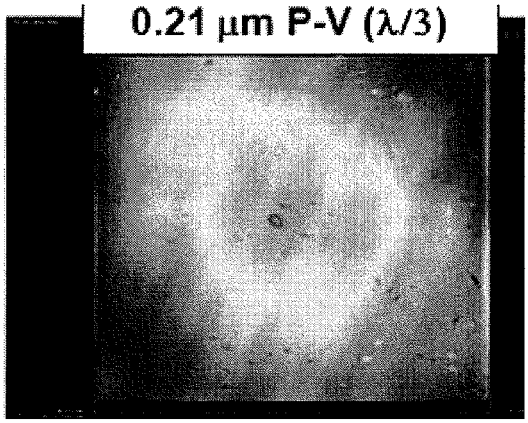

Utilizing the nonaqueous MR fluid described herein, single pass MRF polishing processes were conducted on 50 mm×50 mm×10 mm KDP crystals that were initially finished using SPDT. The polishing process demonstrated a factor of five improvement in surface figure in comparison to conventional techniques, indicating the utility of the nonaqueous MR fluid for MRF polishing of KDP crystals. FIGS. 6A and 6C are interferograms of the surface of a first KDP crystal before and after MRF polishing using a nonaqueous MR fluid according to an embodiment of the present invention.

Figure 6D:
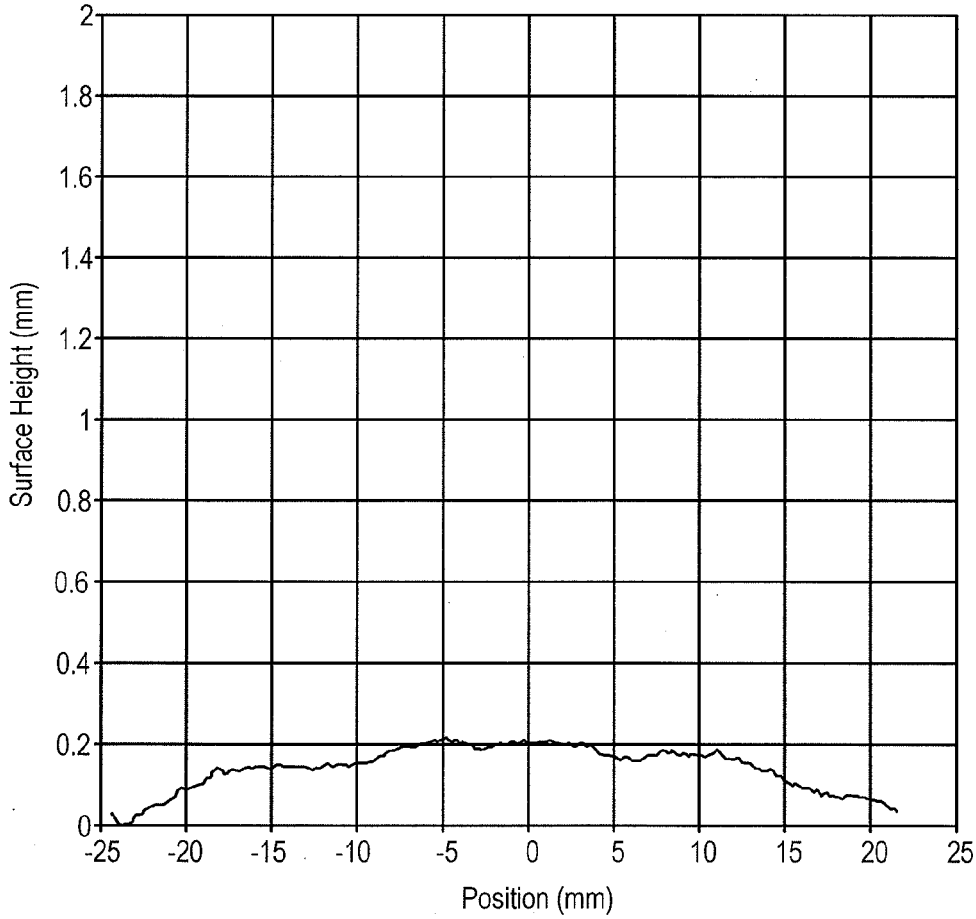

Referring to FIG. 6A, the interferogram of the surface prior to MRF polishing shows the incoming surface figure produced by SPDT. FIG. 6B is a plot illustrating surface height as a function of position for the interferogram illustrated in FIG. 6A. The peak-to-valley (P-V) value is 1.02 μm. It should be noted that the small spots within the interferogram apertures are due to non-uniform adhesion of vinyl tape on the rear surfaces of the KDP crystals (used on the rear surface to eliminate reflection from the rear surface) and are, therefore, an artifact of the measurement method. FIG. 6D is a plot illustrating surface height as a function of position for the interferogram illustrated in FIG. 6C. As shown in FIG. 6D, after single pass MRF polishing of the KDP crystal surface, the surface figure is improved by about five times, to 0.21 μm P-V. It should be noted that this result is similar to surface figure improvements achieved for non-water-soluble optical materials polished using deterministic MRF polishing and aqueous MR fluids.

Figure 7A:
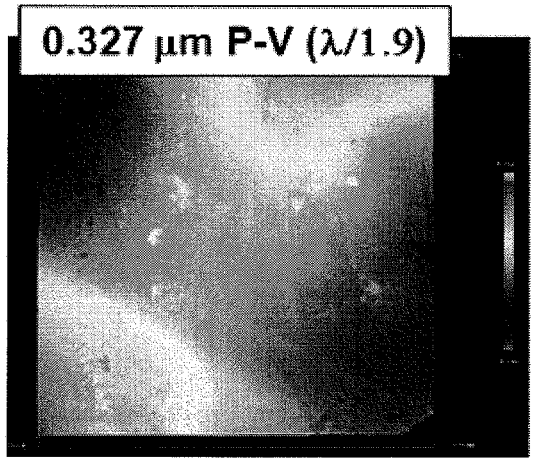
FIGS. 7A and 7C are interferograms of the surface of a second KDP crystal before and after MRF polishing using a nonaqueous MR fluid according to an embodiment of the present invention.
Figure 7B:
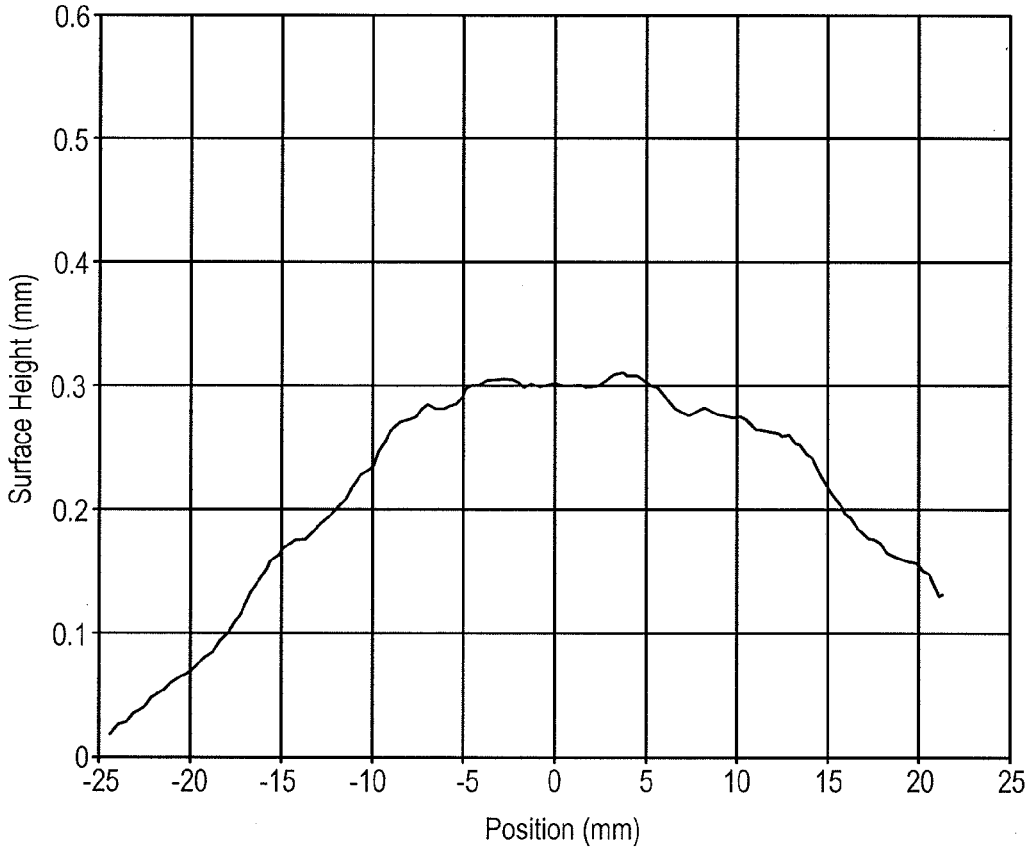
FIGS. 7B and 7D are plots illustrating surface height as a function of position for the interferograms illustrated in FIGS. 7A and 7C, respectively.
Figure 7C:
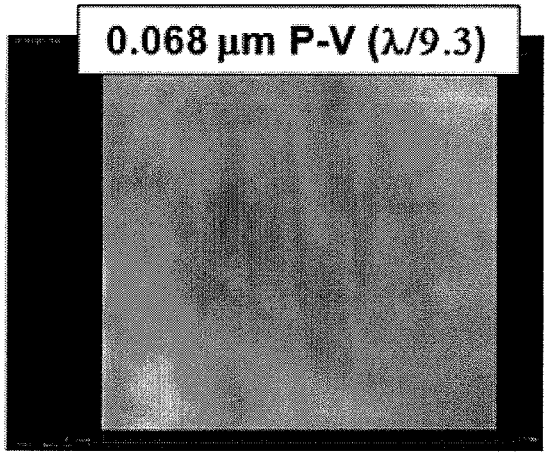
Figure 7D:
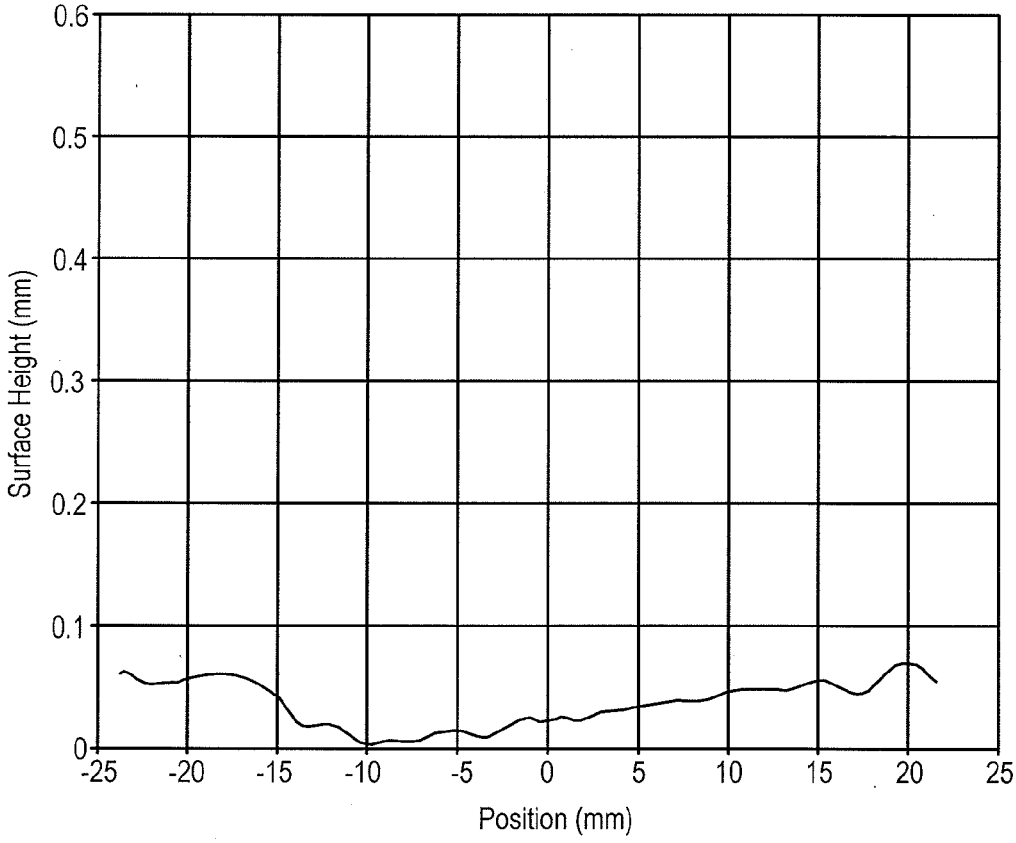

FIGS. 7A and 7C are interferograms of the surface of a second KDP crystal before and after MRF polishing using a nonaqueous MR fluid according to an embodiment of the present invention. FIG. 7B is a plot illustrating surface height as a function of position for the interferogram illustrated in FIG. 7A. As illustrated in FIG. 7B, the P-V value is 0.327 μm after SPDT. FIG. 7D is a plot illustrating surface height as a function of position for the interferogram illustrated in FIG. 7C. After single pass MRF polishing of the KDP crystal surface, the surface figure is improved by about five times, to 0.068 μm P-V.

In order to test the polished surfaces in a high fluence environment, laser damage studies were performed on the MRF polished KDP specimens. Laser damage studies in the infrared at 1064 nm (10-ns equivalent) and in the visible at 532 nm (7.5-ns equivalent) were conducted on several MRF polished KDP specimens to determine the influence of MRF polishing on damage performance versus that obtained using SPDT.

Table 1 lists the results of the infrared and visible laser damage studies for KDP specimens polished using SPDT and by MRF using the nonaqueous MR fluid described herein.

TABLE 1

| Finish | Water | Surface damage threshold ($J/cm^2$) @ 10 ns, 1064 nm | Surface damage threshold ($J/cm^2$) @ 7.5 ns, 532 nm |
|---|---|---|---|
| SPDT (control) | No | 20.1 | 12.0 |
| MRF/carrier only | No | 45.6 | 20.6 |
| MRF/carrier only | Yes | 51.1 | 20.6 |
| MRF/stabilizer neutral | Yes | 45.6 | 20.6 |
| MRF/pH stable | Yes | 98.5 | 25.3 |

In addition to a control sample that was SPDT finished only, the damage study samples included specimens that were MRF polished using carbonyl iron based fluids containing a) nonaqueous carrier fluid only (anhydrous), b) carrier fluid with water, c) carrier fluid, water, and stabilizer at neutral pH, and a final fluid containing d) carrier fluid, water, stabilizer, and a buffer set to control pH at pH 8.

The laser damage studies demonstrated a 2.0-4.9 times improvement in performance in the infrared and a 1.6-2.1 times improvement in the visible versus conventional SPDT finishing technology. Furthermore, optimization of the nonaqueous MR fluid, via addition of water, stabilizer, and pH shows a distinct increase in performance relative to the uncontrolled and unoptimized fluid formulations.

Figure 8:
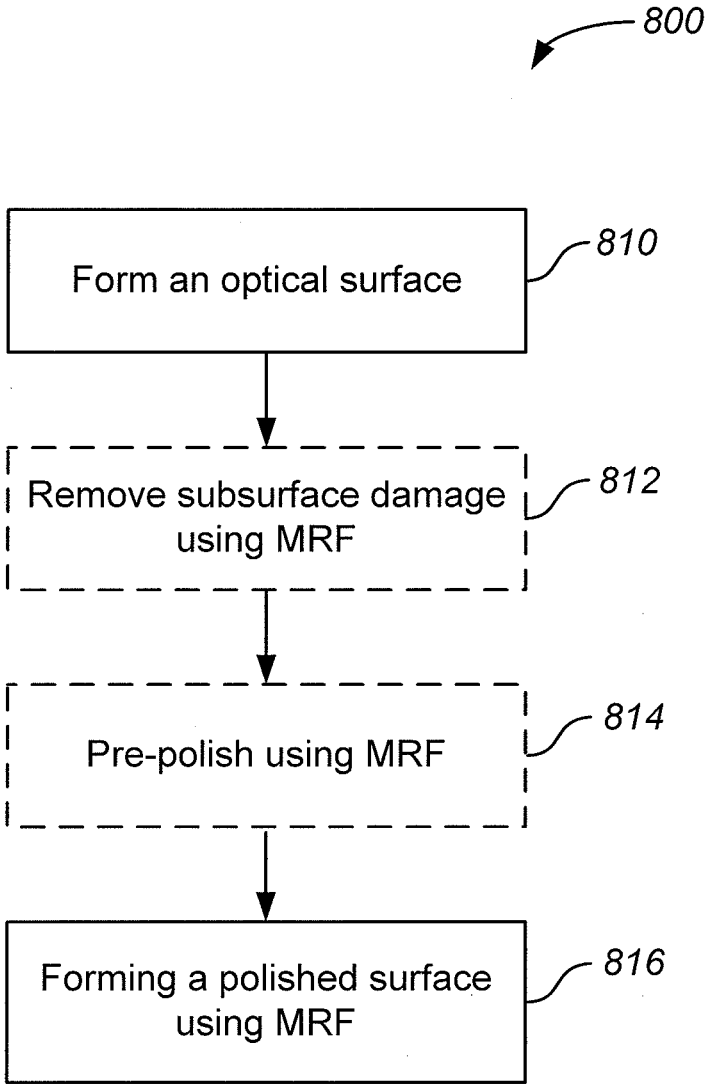
FIG. 8 is a simplified flowchart illustrating a method of polishing an optical element using a nonaqueous MR fluid according to an embodiment of the present invention.

FIG. 8 is a simplified flowchart illustrating a method of polishing a KDP crystal using a nonaqueous MR fluid according to an embodiment of the present invention. In the exemplary embodiment illustrated in FIG. 8, the KDP is an optical element used, for example, in high energy laser systems. Thus, although this example relates particularly to a KDP crystal, embodiments of the present invention are not limited to use with KDP crystals. The method 800 includes forming an optical surface on the surface of the KDP crystal (810). Typically, the optical surface is formed using an SPDT technique to produce a surface of good quality that is then ready to be finished using MRF polishing techniques. As an example, the optical surface can be characterized by a surface figure of less than 4 μm P-V, which can be reduced to a P-V of less than 0.1 μm after MRF polishing.

The method also includes forming a polished surface on the KDP crystal using MRF (816). The MRF process is performed using a nonaqueous MR fluid that includes a carrier liquid (e.g., an ether alcohol such as 2-(2-butoxyethoxy) ethanol or 1-(2-butoxyethoxy)ethanol), magnetizable particles (e.g., carbonyl iron spheres) supported in the carrier liquid, a stabilizer (e.g., potassium oleate) supported in the carrier liquid, a buffer (e.g., KDP/KOH) supported in the carrier liquid, and water supported in the carrier liquid. The MR fluid includes between 0.1% and 2.0% by weight of water. As an example, the MR fluid can include between about 0.2% and 0.3% water by weight. The inclusion of water in the nonaqueous MR fluid is consistent with the definition of nonaqueous since the MR fluid is not mostly water, but only a few percent water by weight. Thus, the MR fluid is nonaqueous, not anhydrous. After MRF polishing, the polished surface of the KDP crystal is characterized by a micro-roughness that is improved with respect to the initial micro-roughness after the formation of the optical surface, for example, a micro-roughness of less than 6 Å rms.

Although embodiments of the present invention are directed to the formation of flat/planar surfaces on the KDP crystals or other water-soluble media, the present invention is not limited to the formation of flat surfaces. In other embodiments in which internal inhomogeneities are present in the media, the surface of the crystal can be formed to include features extending above or below a plane parallel to the surface in order to account for such inhomogeneities. Additional description related to compensating for internal inhomogeneities is found in U.S. patent application Ser. No. 12/760,418, previously incorporated by reference.

As an example, embodiments of the present invention can be used to correct wavefront distortions due to inhomogeneities in an optical element. For an example, a KDP crystal can be assumed to have perfectly flat front and back surfaces, but a non-uniform index profile as a function of position. In real applications, the surfaces will not be perfectly flat, contributing to index variations as a function of position. Thus, embodiments of the present invention consider the variations at the front and back surfaces as well as internal variations in a combined manner, lumping all variations into a single phase variation measurement as a function of position.

Because of the phase variations resulting from propagation through the optical element, a flat laser wavefront will be distorted after passing through the optical element. Focusing of the distorted laser beam will result in non-diffraction limited performance. Additionally, amplification of the distorted laser beam can result in additional increases in wavefront nonuniformity. Embodiments of the present invention can be used to finish the optical element in a manner that minimizes the distortion produced by passing through the optical element, producing a surface profile that is matched to the internal inhomogeneities of the optical element to produce an optical element characterized by a uniform index profile as a function of position.

In an embodiment, the first and second surfaces of the optical element are polished to a "smooth" finish. Metrology is used to characterize the overall phase variation of the gain media as a function of position. The overall phase variation will result from imperfections in the surface profiles as well as internal inhomogeneities. Then one of the surfaces is finished using the MRF system described herein to compensate for the overall phase variation. Thus, a flat laser wavefront will still be flat after propagation through the MRF finished optical element.

According to some embodiments, the method further includes the optional steps of removing damage below the surface of the KDP crystal prior to polishing the surface of the KDP crystal (812) and pre-polishing the surface of the KDP crystal prior to polishing the surface of the KDP crystal (814).

It should be appreciated that the specific steps illustrated in FIG. 8 provide a particular method of polishing a KDP crystal using a nonaqueous MR fluid according to an embodiment of the present invention. Other sequences of steps may also be performed according to alternative embodiments. For example, alternative embodiments of the present invention may perform the steps outlined above in a different order. Moreover, the individual steps illustrated in FIG. 8 may include multiple sub-steps that may be performed in various sequences as appropriate to the individual step. Furthermore, additional steps may be added or removed depending on the particular applications. One of ordinary skill in the art would recognize many variations, modifications, and alternatives.

It is also understood that the examples and embodiments described herein are for illustrative purposes only and that various modifications or changes in light thereof will be suggested to persons skilled in the art and are to be included within the spirit and purview of this application and scope of the appended claims.

What is claimed is:

1. A nonaqueous magnetorheological fluid comprising:
a primarily organic carrier liquid;
magnetizable particles;
a buffer;
a stabilizer; and
water, wherein a pH of the magnetorheological fluid is between 6.5 and 9.0, and wherein the carrier liquid comprises at least one of 2-(2-butoxyethoxy)ethanol or 1-(2-butoxyethoxy)ethanol.

2. The magnetorheological fluid of claim 1 wherein the magnetorheological fluid comprises between 15 and 30 weight percent 2-(2-butoxyethoxy) ethanol or 1-(2-butoxyethoxy) ethanol.

3. The magnetorheological fluid of claim 2 wherein the magnetorheological fluid comprises about 19.6 weight percent 2-(2-butoxyethoxy) ethanol or 1-(2-butoxyethoxy) ethanol.

4. The magnetorheological fluid of claim 1 wherein the magnetizable particles comprise carbonyl iron.

5. The magnetorheological fluid of claim 4 wherein the magnetorheological fluid comprises about 78 weight percent carbonyl iron.

6. The magnetorheological fluid of claim 1 wherein the buffer comprises at least one of KDP/KOH, deuterated derivatives of KDP/KOH, or ADP/KOH.

7. The magnetorheological fluid of claim 6 wherein the magnetorheological fluid comprises about 0.2 weight percent of the buffer.

8. The magnetorheological fluid of claim 1 wherein the stabilizer comprises potassium oleate.

9. The magnetorheological fluid of claim 8 wherein the magnetorheological fluid comprises about 0.6 weight percent potassium oleate.

10. The magnetorheological fluid of claim 1 wherein the magnetorheological fluid comprises between about 0.1 weight percent of water and about 2.0 weight percent of water.

11. The magnetorheological fluid of claim 10 wherein the magnetorheological fluid comprises between about 0.2 weight percent of water and about 0.4 weight percent of water.

12. A fluid for magnetorheological finishing processes, the fluid comprising:
an anhydrous carrier liquid;
a plurality of magnetizable particles supported in the carrier liquid;
a polar stabilizer supported in the carrier liquid;
a buffer liquid supported in the carrier liquid operable to modify a pH of the fluid;
water supported in the carrier liquid, wherein the fluid comprises between 0.1% and 2.0% by weight of water; and wherein the carrier liquid comprises at least one of 2-(2-butoxyethoxy)ethanol, 1-(2-butoxyethoxy)ethanol, an alkoxy alcohol or an arylalkoxy alcohol.

13. The fluid of claim 12 wherein the plurality of magnetizable particles comprise carbonyl iron spheres.

14. The fluid of claim 12 wherein the polar stabilizer comprises at least one of potassium oleate or a salt of saturated or unsaturated fatty acids having chains of 14 to 20 carbon atoms.

15. The fluid of claim 14 wherein the fluid comprises less than 5% by weight of the polar stabilizer.

16. The fluid of claim 12 wherein the pH of the fluid ranges from about 6 to 9.

17. The fluid of claim 12 wherein the buffer liquid comprises at least one of KDP/KOH or ADP/KOH.

18. The fluid of claim 12 wherein the fluid comprises about 0.1% to about 2.0% water by weight.

19. The fluid of claim 18 wherein the fluid comprises about 0.2 to 0.4% water by weight.

* * * * *